US008437677B2

(12) United States Patent
Hasegawa et al.

(10) Patent No.: US 8,437,677 B2
(45) Date of Patent: May 7, 2013

(54) PROTECTING AGENT-SUPPLYING DEVICE, PROCESS CARTRIDGE, IMAGE FORMING APPARATUS AND IMAGE FORMING METHOD

(75) Inventors: Kunio Hasegawa, Tokyo (JP); Hiroshi Nakai, Tokyo (JP); Shinya Tanaka, Tokyo (JP); Taichi Urayama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 12/805,623

(22) Filed: Aug. 10, 2010

(65) Prior Publication Data

US 2011/0038656 A1 Feb. 17, 2011

(30) Foreign Application Priority Data

Aug. 17, 2009 (JP) ..... 2009-188667

(51) Int. Cl.
*G03G 21/00* (2006.01)

(52) U.S. Cl.
USPC ..... 399/346

(58) Field of Classification Search ..... 399/159, 399/252, 343, 346; 430/126.2
See application file for complete search history.

(56) References Cited

U.S. PATENT DOCUMENTS 3,501,294 A 3/1970 Joseph
6,060,205 A * 5/2000 Takeichi et al. ..... 430/126.2
7,383,013 B2 6/2008 Watanabe et al.
7,603,071 B2 * 10/2009 Sugiura et al. ..... 399/346
2009/0196665 A1 8/2009 Tanaka et al.
2009/0279930 A1 11/2009 Kabata et al.
2009/0285613 A1 11/2009 Nakai et al.
2009/0290919 A1 11/2009 Tanaka et al.
2009/0290920 A1 11/2009 Hatakeyama et al.
2009/0311014 A1 12/2009 Tanaka et al.
2010/0034560 A1 2/2010 Tanaka et al.
2010/0054829 A1 3/2010 Iio et al.

FOREIGN PATENT DOCUMENTS

JP 51022380 B 7/1976
JP 2005-309406 A 11/2005
JP 2006350240 A 12/2006
JP 4494261 B2 4/2010

* cited by examiner

*Primary Examiner* — David Gray
*Assistant Examiner* — Gregory H Curran
(74) *Attorney, Agent, or Firm* — Harness, Dickey & Pierce P.L.C.

(57) ABSTRACT

A protecting agent-supplying device which supplies, to an image bearing member, an image bearing member-protecting agent for protecting the image bearing member, wherein the image bearing member-protecting agent contains at least a fatty acid zinc salt and boron nitride, and wherein the protecting agent-supplying device supplies the image bearing member-protecting agent to the image bearing member so that the amount of zinc (Zn) present on a surface of the image bearing member satisfies the relation 0.4≦Zn≦2.5 (Atomic %) and the amount of boron (B) present on the surface of the image bearing member satisfies the relation 0.2≦B≦30.2 (Atomic %).

18 Claims, 2 Drawing Sheets

PROTECTING AGENT-SUPPLYING DEVICE, PROCESS CARTRIDGE, IMAGE FORMING APPARATUS AND IMAGE FORMING METHOD

BACKGROUND OF THE INVENTION

1. Field of the Invention

The present invention relates to a protecting agent-supplying device which supplies an image bearing member-protecting agent for protecting an image bearing member in image forming apparatuses such as copiers, facsimiles and printers, a process cartridge containing the protecting agent-supplying device, an image forming apparatus containing the protecting agent-supplying device or the process cartridge, and an image forming method using the protecting agent-supplying device, the process cartridge or the image forming apparatus.

2. Description of the Related Art

In image forming apparatuses (e.g., copiers, facsimiles and printers) having an image bearing member (e.g., a photoconductor made of, for example, a photoconductive compound), the image bearing member is rotated and subjected sequentially to, for example, a charging step, an exposing step, a developing step, a transfer step and a fixing step for image formation.

In the charging step, the surface of the image bearing member is charged with a charging member such as a charging roller. In the exposing step, a latent electrostatic image is formed on the surface of the image bearing member whose surface has been charged in the charging step. In the developing step, charged tone particles are made to adhere to the latent electrostatic image on the image bearing member surface, to thereby form a visible image. In the transfer step, the visible image is transferred from the image bearing member onto a recording medium (transfer medium) such as a paper sheet. In the fixing step, the visible image transferred onto the recording medium is fixed thereon with, for example, heat, pressure or gaseous solvent. Through these steps, an output image is formed on the recording medium.

The developing method in the developing step is roughly classified, depending on the method of charging toner particles, into a two-component developing method and a one-component developing method. In the two-component developing method, toner particles are stirred/mixed with carrier particles and are frictionally charged. In the one-component developing method, toner particles are charged with no use of carrier particles. The one-component developing method is further classified into a magnetic one-component developing method and a non-magnetic one-component developing method, depending on whether or not the developer bearing member (for bearing toner particles) retains toner particles by a magnetic force.

Of these developing methods, the two-component developing method is often employed in, for example, copiers required for high-speed processing and developing reproducibility, and complex machines employing such copiers, in terms of charging stability of the toner particles, charge rising property, long-term stability of image quality, and other requirements. Meanwhile, the one-component developing method is often employed in the compact printers and facsimiles.

In recent years, color images are generally formed, and thus, demand has increasingly arisen for high image quality and stability of image quality. These requirements are intended to be met not by improving the developing method, but by decreasing the average particle diameter of toner particles and using more spherical toner particles. For example, toners produced with the polymerization method are seen on the market. These toners have advantageous features in that they have less angular portions and a uniform average particle diameter, as compared with toners produced with the pulverizing method. In addition, the polymerized toners contribute to not only improvement of image quality but also saving of production energy.

The image bearing member having undergone the transfer step has, on the surface thereof, residual toner components which have not been transferred onto the recording medium. When charged again in the charging step in this state, the image bearing member is not uniformly charged in many cases. Thus, in general, a cleaning step is additionally provided after the transfer step and before the next charging step. In the cleaning step, the toner components and other foreign matters (e.g., paper dust) remaining on the image bearing member are removed with a cleaning member such as a cleaning blade, and the image bearing member surface is sufficiently cleaned before the charging step.

The recent toner particles have a smaller average particle diameter and a more spherical shape as described above. Such toner particles are more difficult to remove in the cleaning step. In one countermeasure against this, the cleaning member is pressed against the image bearing member surface at larger pressures.

As described above, the image bearing member receives various physical or electrical stresses in the above steps, and the state thereof changes over tithe, especially after long-term use. For example, the image bearing member receives considerable electrical stress in the contact charging method or close-contact charging method (which involves a discharging phenomenon in the vicinity of the image bearing member surface), since, in these charging methods, many active species or reaction products are formed on the image bearing member surface, and active species or reaction products formed in air within the discharging region adsorb on the image bearing member surface in a large amount. Also, it is known that, when the alternating voltage is employed in the charging step, the stress caused by the application of the voltage abrades the image bearing member. In addition, as has been known, the stress caused by the friction in the cleaning step abrades and scratches the image bearing member, and also abrades the cleaning member. Thus, conventionally, many researchers have proposed methods of supplying a lubricant or lubricating ingredients and of forming a film on the image bearing member surface from the lubricant or lubricating ingredients, in order to reduce the friction force between the image bearing member and the cleaning member.

For example, some patent literatures disclose techniques of forming a lubricant film on the surface of a photoconductor (image bearing member) by supplying a lubricant (image bearing member-protecting agent) onto the photoconductor surface to elongate the service lives of the photoconductor and the cleaning member (see, for example, Japanese Patent Application Publication (JP-B) No. 51-22380, and Japanese Patent Application Laid-Open (JP-A) Nos. 2005-309406 and 2006-350240). Using the above techniques, the stress applied to the image bearing member in, for example, the charging step can be easily reduced.

Meanwhile, for the lubricant, there are known lubricants mainly containing a fatty acid zinc salt (see, for example, JP-B No. 51-22380 and JP-A No. 2005-309406) and lubricants containing boron nitride and a zinc salt of fatty acid (see, for example, JP-A No. 2006-350240). The latter lubricants decrease in lubricity to a less extent than in the former lubricants, even when receiving the stress due to discharge in the charging step. In addition, even when the recent small/spherical toner particles are used, the latter lubricants are suitable for suppressing or preventing the cleaning member from being abraded, and suppressing or preventing the toner particles from running through the cleaning member to stain the charging member or adversely affect the formed image. Furthermore, they are suitable for suppressing or preventing the lubricating ingredients as well as toner particles from running through the cleaning member to stain the charging member.

In recent years, cleaning performance for toner has been remarkably improved in the cleaning steps, and the recent small and highly spherical toner particles are cleaned effectively. Such improved cleaning performance prevents toner particles from running through the cleaning step, which prevents the photoconductor and cleaning member from being abraded (i.e., their service lives from being shortened) and the charging member from being stained (i.e., the service life from being shortened). In view of this, the supply of the latter lubricant onto the photoconductor is advantageous in elongating the service lives of the photoconductor, the cleaning member (in the cleaning step) and the charging member.

Here, according to JP-A No. 2005-309406, the amount of the lubricant supplied to the photoconductor surface is adjusted to be 0.4 atm % to 2.5 atm % on the basis of the amount of zinc contained in the lubricant so that, even when small/spherical toner particles are used, filming on the photoconductor is prevented for the photoconductor surface to be protected.

BRIEF SUMMARY OF THE INVENTION

However, the present inventors studied on the amount of the latter lubricant supplied to the photoconductor, and have revealed that image formation can be affected depending on the amount of boron present on the surface of the photoconductor surface.

The present invention aims to provide a protecting agent-supplying device which supplies, onto an image bearing member, an image bearing member-protecting agent containing a fatty acid zinc salt and boron nitride in such an appropriate amount that achieves the intended purposes, a process cartridge containing the protecting agent-supplying device, an image forming apparatus containing the protecting agent-supplying device or the process cartridge, and an image forming method using the protecting agent-supplying device, the process cartridge or the image forming apparatus.

The present invention is based on the finding obtained by the present inventors. Means for solving the above problems are as follows.

<1> A protecting agent-supplying device which supplies, to an image bearing member, an image bearing member-protecting agent for protecting the image bearing member, wherein the image bearing member-protecting agent contains at least a fatty acid zinc salt and boron nitride, and wherein the protecting agent-supplying device supplies the image bearing member-protecting agent to the image bearing member so that the amount of zinc (Zn) present on a surface of the image bearing member satisfies the relation $0.4 \leqq Zn \leqq 2.5$ (Atomic %) and the amount of boron (B) present on the surface of the image bearing member satisfies the relation $0.2 \leqq B \leqq 30.2$ (Atomic %).

<2> The protecting agent-supplying device according to <1> above, wherein the fatty acid zinc salt is zinc stearate.

<3> The protecting agent-supplying device according to one of <1> and <2> above, wherein the protecting agent-supplying device includes a supplying member which scrapes off the image bearing member-protecting agent and supplies the image bearing member-protecting agent to the image bearing member.

<4> The protecting agent-supplying device according to any one of <1> to <3> above, wherein the protecting agent-supplying device includes a layer-forming member which forms a layer, on the image bearing member, of the image bearing member-protecting agent supplied to the image bearing member.

<5> A process cartridge including:

the protecting agent-supplying device according to any one of <1> to <4> above, and an image bearing member to which the image bearing member-protecting agent is supplied by the protecting agent-supplying device.

<6> An image forming apparatus including:

the process cartridge according to <5> above.

<7> An image forming apparatus including:

the protecting agent-supplying device according to any one of <1> to <4> above, and an image bearing member to which the image bearing member-protecting agent is supplied by the protecting agent-supplying device.

<8> The image forming apparatus according to one of <6> and <7> above, further including a cleaning device for removing from the image bearing member toner particles remaining on the image bearing member, wherein the cleaning device is provided so as to be in contact with the image bearing member, and wherein the cleaning device is located, in a direction in which the image bearing member is moved, downstream of a position where a toner image on the image bearing member is transferred onto a recording medium but upstream of a position where the image bearing member-protecting agent is supplied by the protecting agent-supplying device.

<9> The image forming apparatus according to any one of <6> to <8> above, wherein the image bearing member has a layer containing a thermosetting resin at least the uppermost surface thereof.

<10> The image forming apparatus according to any one of <6> to <9> above, wherein the image bearing member is a photoconductor.

<11> The image forming apparatus according to any one of <6> to <9> above, wherein the image bearing member is an intermediate transfer member.

<12> The image forming apparatus according to any one of <6> to <11> above, further including a charging unit which is provided so as to face the image bearing member and configured to charge the image bearing member.

<13> The image forming apparatus according to <12> above, wherein the charging unit includes a voltage-applying unit configured to apply a voltage containing an alternating-current component.

<14> An image forming method including:

performing image formation with the protecting agent-supplying device according to any one of <1> to <4> above, the process cartridge according to <5> above, or the image forming apparatus according to any one of <6> to <13> above.

The present invention provides a protecting agent-supplying device which supplies to an image bearing member an image bearing member-protecting agent for protecting the image bearing member. Specifically, the image bearing member-protecting agent contains at least a fatty acid zinc salt and boron nitride, and the protecting agent-supplying device supplies the image bearing member-protecting agent to the image bearing member so that the amount of zinc (Zn) present on a surface of the image bearing member satisfies the relation 0.4≦Zn≦2.5 (Atomic %) and the amount of boron (B) present on the surface of the image bearing member satisfies the relation 0.2≦B≦30.2 (Atomic %). When the image bearing member-protecting agent containing the fatty acid zinc salt and boron nitride is supplied to the image bearing member using the protecting agent-supplying device, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the protecting agent-supplying device can contribute to elongation of the service lives of the image bearing member and other members, and also to favorable image formation for a long period of time.

The present invention provides a protecting agent-supplying device in which the image bearing member-protecting agent containing boron nitride and zinc stearate as the zinc salt is used. Zinc stearate is a compound having a lamella crystal (multilayer) structure in which amphoteric molecules are self-assembled. When a shearing force is applied thereto, crystals are cleaved and slid along the interlayer spaces. This compound is inexpensive and highly hydrophobic, and gives the image bearing member excellent protection against electrical stress. When the image bearing member-protecting agent containing zinc stearate and boron nitride is supplied to the image bearing member using the protecting agent-supplying device, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the protecting agent-supplying device can contribute to elongation of the service lives of the image bearing member and other members. Also, since the protecting agent-supplying device uses the image bearing member-protecting agent containing zinc stearate, water repellency of the image bearing member surface is maintained by virtue of the hydrophobicity of zinc stearate, resulting in that water permeation of the image bearing member surface is suppressed to prevent image blur. Furthermore, the protecting agent-supplying device can contribute to favorable image formation for a long period of time.

When the protecting agent-supplying device contains a supplying member which scrapes off the image bearing member-protecting agent and supplies the image bearing member-protecting agent to the image bearing member, an appropriate amount of the image bearing member-protecting agent can be consistently supplied to the image bearing member by the supplying member for a long period of time. Thus, when the image bearing member-protecting agent containing the fatty acid zinc salt and boron nitride is supplied to the image bearing member using the protecting agent-supplying device, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the protecting agent-supplying device can contribute to elongation of the service lives of the image bearing member and other members, and also to favorable image formation for a long period of time.

When the protecting agent-supplying device contains a layer-forming member which forms a layer, on the image bearing member, of the image bearing member-protecting agent supplied to the image bearing member, the image bearing member-protecting agent can effectively protect the image bearing member. Also, when the image bearing member is exposed to light, unfavorable phenomena due to the image bearing member-protecting agent during light exposure can be prevented from occurring. Thus, when the image bearing member-protecting agent containing the fatty acid zinc salt and boron nitride is supplied to the image bearing member using the protecting agent-supplying device, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the protecting agent-supplying device can contribute to elongation of the service lives of the image bearing member and other members, and also to favorable image formation for a long period of time.

The process cartridge of the present invention includes the protecting agent-supplying device and an image bearing member to which the image bearing member-protecting agent is supplied by the protecting agent-supplying device. Thus, when the image bearing member-protecting agent containing the fatty acid zinc salt and boron nitride is supplied to the image bearing member using the protecting agent-supplying device contained in the process cartridge, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the process cartridge can contribute to elongation of the service lives of the image bearing member and other members, and also to favorable image formation for a long period of time. Furthermore, the process cartridge can be elongated in service life before replacement, and the constituent parts (e.g., the image bearing member) can be recycled to attain waste reduction.

The image forming apparatus of the present invention contains the above-described process cartridge. Thus, when the image bearing member-protecting agent containing the fatty acid zinc salt and boron nitride is supplied to the image bearing member using the protecting agent-supplying device contained in the process cartridge, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the process cartridge can contribute to elongation of the service lives of the image bearing member and other members, and also to favorable image formation for a long period of time. Furthermore, the process cartridge can be elongated in service life before replacement to reduce running cost, and the constituent parts (e.g., the image bearing member) can be recycled to attain waste reduction.

The image forming apparatus of the present invention includes the above-described protecting agent-supplying device and an image bearing member to which the image bearing member-protecting agent is supplied by the protecting agent-supplying device. Thus, when the image bearing member-protecting agent containing the fatty acid zinc salt and boron nitride is supplied to the image bearing member using the protecting agent-supplying device, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the image forming apparatus can contribute to elongation of the service lives of the image bearing member and other members, and also to favorable image formation for a long period of time. Furthermore, the image bearing member or other members can be elongated in service life before replacement to reduce running cost, and the constituent parts (e.g., the image bearing member) can be recycled to attain waste reduction.

When the image forming apparatus of the present invention further includes the cleaning device which is provided so as to be in contact with the image bearing member and is located, in a direction in which the image bearing member is moved, downstream of a position where a toner image on the image bearing member is transferred onto a recording medium but upstream of a position where the image bearing member-protecting agent is supplied by the protecting agent-supplying device, the image bearing member-protecting agent can be applied to the image bearing member having undergone cleaning by the cleaning device, and thus, the image bearing member can be effectively protected by the image bearing member-protecting agent. Thus, when the image bearing member-protecting agent containing the fatty acid zinc salt and boron nitride is supplied to the image bearing member using the protecting agent-supplying device contained in the image forming apparatus, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the image forming apparatus can contribute to elongation of the service lives of the image bearing member and other members, and also to favorable image formation for a long period of time. Furthermore, the image bearing member or other members can be elongated in service life before replacement to reduce running cost, and the constituent parts (e.g., the image bearing member) can be recycled to attain waste reduction.

When the image bearing member has a layer containing a thermosetting resin at least the uppermost surface thereof, the resistance of the image bearing member to electrical stress is improved by virtue of the thermosetting resin. Thus, when the image bearing member-protecting agent containing the fatty acid zinc salt and boron nitride is supplied to the image bearing member using the protecting agent-supplying device contained in the image forming apparatus, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the image forming apparatus can contribute to elongation of the service lives of the image bearing member and other members, and also to favorable image formation for a long period of time. Furthermore, the image bearing member or other members can be elongated in service life before replacement to reduce running cost, and the constituent parts (e.g., the image bearing member) can be recycled to attain waste reduction.

In the case where the image bearing member is a photoconductor, when the image bearing member-protecting agent containing the fatty acid zinc salt and boron nitride is supplied to the photoconductor using the protecting agent-supplying device contained in the image forming apparatus, the photoconductor can be protected from degradation due to abrasion while filming thereon and staining of the charging member are suppressed or prevented. In this manner, the image bearing member-protecting agent can protect the photoconductor. Thus, the image forming apparatus can contribute to elongation of the service lives of the photoconductor, the charging member and other members, and also to favorable image formation for a long period of time. Furthermore, the photoconductor, the charging member and other members can be elongated in service life before replacement to reduce running cost, and the constituent parts (e.g., the photoconductor, the charging member and the image bearing member) can be recycled to attain waste reduction.

In the case where the image bearing member is an intermediate transfer member, when the image bearing member-protecting agent containing the fatty acid zinc salt and boron nitride is supplied to the intermediate transfer member using the protecting agent-supplying device contained in the image forming apparatus, the intermediate transfer member can be protected from degradation due to abrasion while filming thereon is suppressed or prevented. Also, when a charging member is disposed so as to face the intermediate transfer member, the intermediate transfer member can be protected while staining of the charging member is suppressed or prevented. In this manner, the image bearing member-protecting agent can protect the intermediate transfer member. Thus, the image forming apparatus can contribute to elongation of the service lives of the intermediate transfer member and other members, and also to favorable image formation for a long period of time. Furthermore, the intermediate transfer member or other members can be elongated in service life before replacement to reduce running cost, and the constituent parts (e.g., the intermediate transfer member) can be recycled to attain waste reduction.

In the case where the image forming apparatus further includes a charging unit provided so as to face the image bearing member and configured to charge the image bearing member, when the image bearing member-protecting agent containing the fatty acid zinc salt and boron nitride is supplied to the image bearing member using the protecting agent-supplying device contained in the image forming apparatus, the image bearing member can be protected from degradation due to abrasion while filming thereon and staining of the charging member are suppressed or prevented. In this manner, the image bearing member-protecting agent can protect the image bearing member. Thus, the image forming apparatus can contribute to elongation of the service lives of the image bearing member and the charging member, and also to favorable image formation for a long period of time. Furthermore, the image bearing member, the charging member and other members can be elongated in service life before replacement to reduce running cost, and the constituent parts (e.g., the image bearing member and the charging member) can be recycled to attain waste reduction.

When the charging unit includes a voltage-applying unit configured to apply a voltage containing an alternating-current component, high electrical stress (caused by a voltage containing an alternating-current component derived from the charging unit) applied on the image bearing member can be suppressed. Thus, when the image bearing member-protecting agent containing the fatty acid zinc salt and boron nitride is supplied to the image bearing member using the protecting agent-supplying device contained in the image forming apparatus, the image bearing member can be protected from degradation due to abrasion while filming thereon and staining of the charging member are suppressed or prevented. In this manner, the image bearing member-protecting agent can protect the image bearing member. Thus, the image forming apparatus can contribute to elongation of the service lives of the image bearing member and the charging member, and also to favorable image formation for a long period of time. Furthermore, the image bearing member and the charging member can be elongated in service life before replacement to reduce running cost, and the constituent parts (e.g., the image bearing member and the charging member) can be recycled to attain waste reduction.

The image forming method of the present invention performs image formation with the above-described protecting agent-supplying device, the above-described process cartridge or the above-described image forming apparatus. Thus, when the image bearing member-protecting agent containing the fatty acid zinc salt and boron nitride is supplied to the image bearing member, the image bearing member can be protected from degradation due to abrasion while filming thereon is suppressed or prevented. Also, when a charging member is disposed so as to face the image bearing member, the image bearing member can be protected while staining of the charging member is suppressed or prevented. In this manner, the image bearing member-protecting agent can protect the image bearing member. Thus, the image forming method can contribute to elongation of the service lives of the image bearing member and other members, and also to favorable image formation for a long period of time. Furthermore, the image bearing member or other members can be elongated in service life before replacement to reduce running cost, and the constituent parts (e.g., the image bearing member) can be recycled to attain waste reduction.

DETAILED DESCRIPTION OF THE INVENTION

Figure 1:
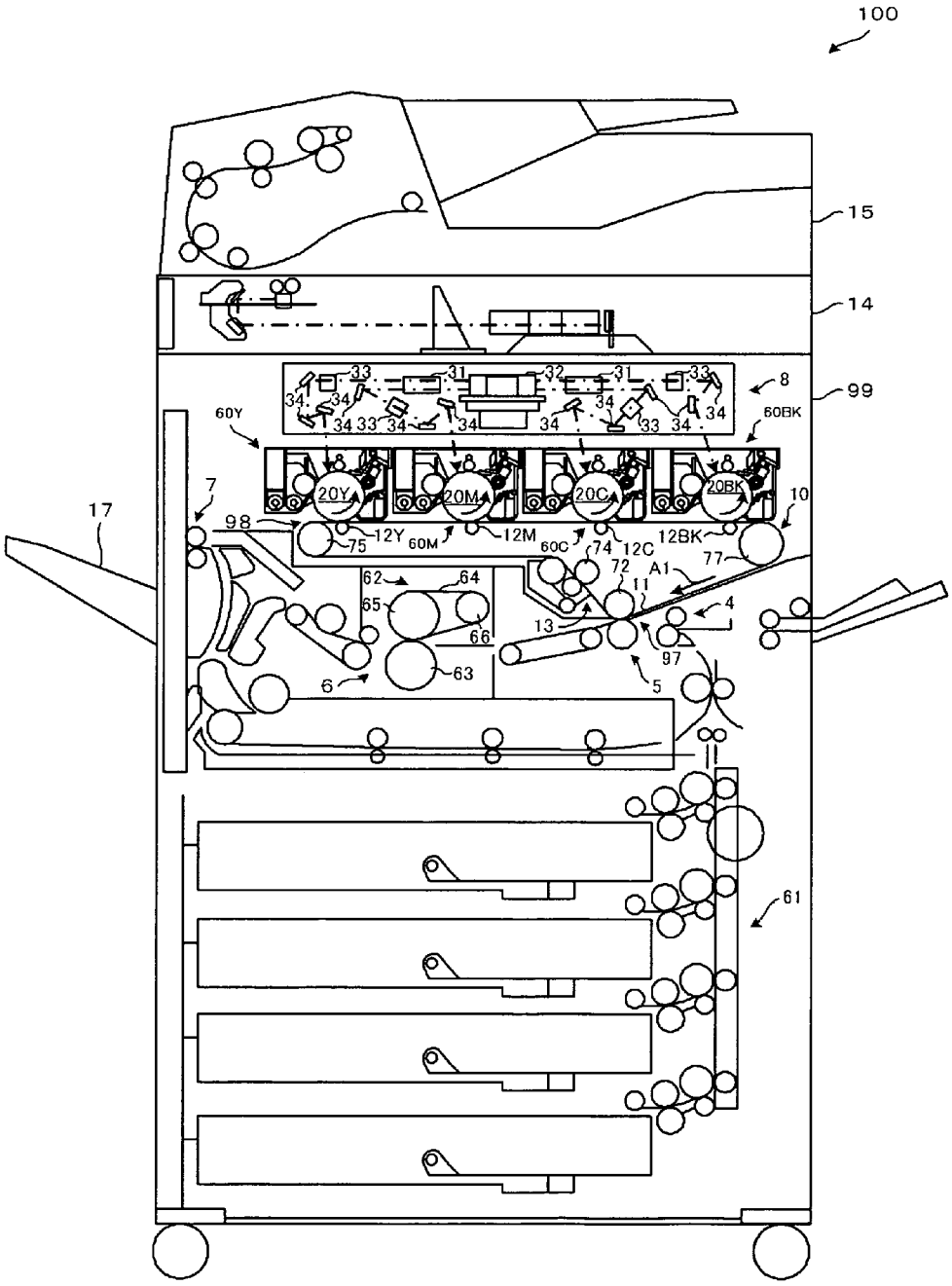
FIG. 1 is a schematic elevation of an image forming apparatus to which the present invention is applied.

FIG. 1 schematically illustrates an image forming apparatus to which the present invention is applied. An image forming apparatus 100 is a complex machine of a color laser copier and a printer, but may be other image forming apparatuses such as other types of copiers, facsimiles, printers and complex machines thereof. The image forming apparatus 100 performs image forming processing on the basis of image signals corresponding to image data of an original document read by the image forming apparatus 100, or to image information the image forming apparatus 100 received from the outside. The image forming apparatus 100 can perform image formation on recording media (recording sheets) such as heavy paper (e.g., OHP sheets, cards and postcards) and mailing envelopes as well as plain paper commonly used in, for example, copying.

The image forming apparatus 100 employees a so-called tandem method based on a tandem structure, in which photoconductor drums (latent image bearing member) 20Y, 20M, 20C and 20BK are arranged in parallel. These photoconductor drums are image bearing members which are able to form images of colors of yellow, magenta, cyan and black.

The photoconductor drums 20Y, 20M, 20C and 20BK (the surfaces of these members are moved) are rotatably housed in an unillustrated frame of a main body 99 of the image forming apparatus 100, and arranged in this order along the direction indicated by arrow A1; i.e., the direction in which a transfer belt 11 (image bearing member (transfer medium)) is moved. The characters Y, M, C and BK after the reference numbers indicate that the corresponding members are respectively members for yellow, magenta, cyan and black.

The photoconductor drums 20Y, 20M, 20C and 20BK are contained respectively in image forming units 60Y, 60M, 60C and 60BK, which forms images of yellow (Y), magenta (M), cyan (C) and black (BK).

The photoconductor drums 20Y, 20M, 20C and 20BK are located at the outer surface (i.e., at the side where images are to be formed) of the transfer belt 11 which is an intermediate transfer medium (member). The intermediate transfer medium is an endless belt which is disposed slightly above the center portion of the main body 99.

The transfer belt 11 can be moved along the direction indicated by arrow A1 with facing the photoconductor drums 20Y, 20M, 20C and 20BK. The visible images (toner images) formed on the photoconductor drums 20Y, 20M, 20C and 20BK are transferred in a superposed manner onto the transfer belt 11 moving along the A1 direction. After that, the composite image is transferred at one time onto an unillustrated recording paper (i.e., a transfer medium (a recording medium)).

The transfer belt 11 faces the photoconductor drums 20Y, 20M, 20C and 20BK at the upper side, and primary transfer portions 98 are formed between the transfer belt and the photoconductor drums. In the primary transfer portions, the toner images on the photoconductor drum 20Y, 20M, 20C and 20BK are transferred onto the transfer belt 11.

The toner images formed on the photoconductor drums 20Y, 20M, 20C and 20BK are transferred or superposed on the same position of the transfer belt 11, with the transfer belt 11 is being moved in the A1 direction. Specifically; primary transfer rollers 12Y, 12M, 12C and 12BK apply a voltage at different timings from upstream to downstream in the A1 direction so that the toner images are sequentially superposed on the same position of the transfer belt. The primary transfer rollers are disposed at positions facing the photoconductor drums 20Y, 20M, 20C and 20BK via the transfer belt 11.

The transfer belt 11 has a volume resistance (conductivity) of $10^5$ Ω·cm to $10^{11}$ Ω·cm. When the surface resistance is lower than $10^5$ Ω/sq., the toner images may be changed during discharge upon transfer of the toner image from the photoconductor drums 20Y, 20M, 20C and 20BK onto the transfer belt 11 (so-called toner scattering during transfer). When the surface resistance exceeds $10^{11}$ Ω/sq., the counter charges against the toner images remain on the transfer belt 11 after transfer of the toner images from the transfer belt 11 onto the recording paper, resulting in that an afterimage may be formed on the image obtained in the next cycle.

The transfer belt 11 may be, for example, a belt-shaped or cylindrical plastic, which is formed by extruding a kneaded product of a thermoplastic resin and a conductive polymer and/or conductive particles such as carbon black and metal oxides (e.g., tin oxide and indium oxide). Alternatively, the transfer belt 11 may be an endless belt which is formed through centrifugal molding under heating of a resin liquid containing a thermocrosslinkable monomer or oligomer and optionally containing the aforementioned conductive particles and/or conductive polymer.

When a surface layer is provided on the transfer belt 11, the surface layer may be made of the composition containing the materials (except for the charge transport material) for forming a surface layer of the below-described photoconductor drum 20Y. In this case, the composition may be appropriately changed in resistance with a conductive compound before use.

The transfer belt 11 has, at the edges, unillustrated skew-preventing guides serving as skew-preventing members. The skew-preventing guides are disposed for preventing the transfer belt 11 from skewing toward the back or the front of FIG. 1 during the rotation in the A1 direction. The skew-preventing guide is made of urethane rubber, and may also be made of other rubbers such as silicone rubber.

The image forming apparatus 100 includes, in the main body 99, four image forming units 60Y, 60M, 60C and 60BK, a transfer belt unit 10, a secondary transfer roller 5 and a light-scanning device 8. Here, the transfer belt unit is an intermediate transfer unit which has the transfer belt 11 and is disposed below the photoconductor drums 20Y, 20M, 20C and 20BK so as to face them. The secondary transfer roller is a secondary transfer bias roller (transfer member) which is disposed so as to face the transfer belt 11, and is moved and rotated correspondingly to the rotation of the transfer belt 11. The light-scanning device is a light-writing unit (latent image forming unit) which is disposed above the image forming units 60Y, 60M, 60C and 60BK so as to face them.

The image forming apparatus 100 also includes, in the main body 99, a sheet-feeding device 61, a pair of registration rollers 4 and an unillustrated sensor. Here, the sheet-feeding device is a paper-feeding cassette (paper-feeding mechanism) capable of storing many sheets of recording paper, which are conveyed to between the photoconductor drums 20Y, 20M, 20C and 20BK and the transfer belt 11. The registration rollers feed the recording paper sheet, which have been conveyed from the sheet-feeding device 61, to a secondary transfer portion 97 between the transfer belt 11 and the secondary transfer roller 5 at a predetermined timing corresponding to the toner image formation by the image forming units 60Y, 60M, 60C and 60BK. The unillustrated sensor detects that the top end of each recording paper sheet reached the registration rollers 4.

The image forming apparatus 100 also includes, in the main body 99, a fixing device 6, paper-discharging rollers 7 and a discharge tray 17. Here, the fixing device is a fixing unit in the belt-fixing method which is for fixing the transferred toner image on the recording paper sheet. The paper-discharging rollers are a pair of rollers for discharging the fixed recording paper sheet to the outside of the main body 99. The discharge tray 17 receives the recording paper sheets discharged by the discharging rollers 7 to the outside of the main body 99.

The image forming apparatus 100 also includes, above the main body 99, a reading device 14 and an automatic document feeder (i.e., ADF) 15. The reading device reads an image of the original document. The automatic document feeder is disposed above the reading device 14 and feeds the original document to the reading device 14.

The image forming apparatus 100 also includes unillustrated driving devices, unillustrated power supply, unillustrated bias-controlling units and an unillustrated controlling unit. Here, the driving devices rotate the photoconductor drums 20Y, 20M, 20C and 20BK. The power supply and bias-controlling units are bias-applying units configured to apply secondary transfer bias to the secondary transfer roller 5. The controlling unit contains CPU, a memory, etc. and controls overall operation of the image forming apparatus 100 on the basis of, for example, the data detected by various detection units.

The transfer belt unit 10 includes, in addition to the transfer belt 11, primary transfer rollers 12Y, 12M, 12C and 12BK (primary transfer bias rollers), a drive roller 72 (driving member around which the transfer belt 11 is wound), a cleaning counter roller 74, supporting rollers 75 and 77 (which support the transfer belt 11 together with the drive roller 72 and the cleaning counter roller 74) and a cleaning device 13 (which is disposed so as to face the transfer belt 11 and cleans the transfer belt 11).

The transfer belt unit 10 also has an unillustrated driving system (by which the drive roller 72 is rotated) and an unillustrated power supply and unillustrated bias-controlling units (which are bias-applying units configured to apply primary transfer bias to the primary transfer rollers 12Y, 12M, 12C and 12BK).

The primary transfer rollers 12Y, 12M, 12C and 12BK press the back surface of the transfer belt 11 against the photoconductor drums 20Y, 20M, 20C and 20BK so as to form primary transfer nips.

Due to the primary transfer biases, a primary transfer electrical field is formed in the primary transfer nips between the photoconductor drums 20Y, 20M, 20C and 20BK and the primary transfer rollers 12Y, 12M, 12C and 12BK. The toner images of colors formed on the photoconductor drums 20Y, 20M, 20C and 20BK are primarily transferred onto the transfer belt 11 by virtue of the primary transfer electrical field and the nip pressure.

The drive roller 72 is disposed so as to come into contact with the secondary transfer roller 5 via the transfer belt 11, and forms a secondary transfer nip.

The supporting roller 75 serves as a tension roller (press member) which gives the transfer belt 11 a predetermined tension suitable for transfer.

The cleaning device 13 has a cleaning brush and a cleaning blade which are disposed so as to face and be in contact with the transfer belt 11 (detail illustration is omitted), and is configured to scrape off and remove foreign matter (e.g., residual toner particles) on the transfer belt 11 by the cleaning brush and the cleaning blade for cleaning the transfer belt 11.

The sheet-feeding device 61 accommodates many recording paper sheets in a stacked state (in bundle), and is disposed in multiple steps at the lower side of the main body 99. The sheet-feeding device 61 feeds paper sheets to a pair of registration rollers 4 at a predetermined timing.

The recording paper sheets, which have been fed from the sheet-feeding device 61, reach the registration rollers 4 through the paper-feeding pathway, and are sandwiched between the registration rollers 4.

The fixing device 6 has a belt unit 62 and a press roller 63 pressed against the belt unit 62. The belt unit 62 has an endless fixing belt 64, a fixing roller 65 (which moves the endless fixing belt 64 with supporting it) and a heating roller 66 (which has an unillustrated heat source therein and supports the endless fixing belt 64 together with the fixing roller 65).

The fixing device 6 fixes the toner image, by the action of heat and pressure, on the recording paper sheet which has fed to the fixing part (pressed portion) between the belt unit 62 and the press roller 63.

Next, description will be given with respect to the image forming unit 60Y, containing the photoconductor drum 20Y, among the image forming units 60Y, 60M, 60C and 60BK. Notably, since the configuration of the image forming unit 60Y is substantially the same as those of the other image forming units, detail descriptions thereof are appropriately omitted. Also, for the sake of convenience in the following description, the reference numerals of the constituent members of the image forming unit 60Y are used to denote the constituent members of the other image forming units, or are omitted.

Figure 2:
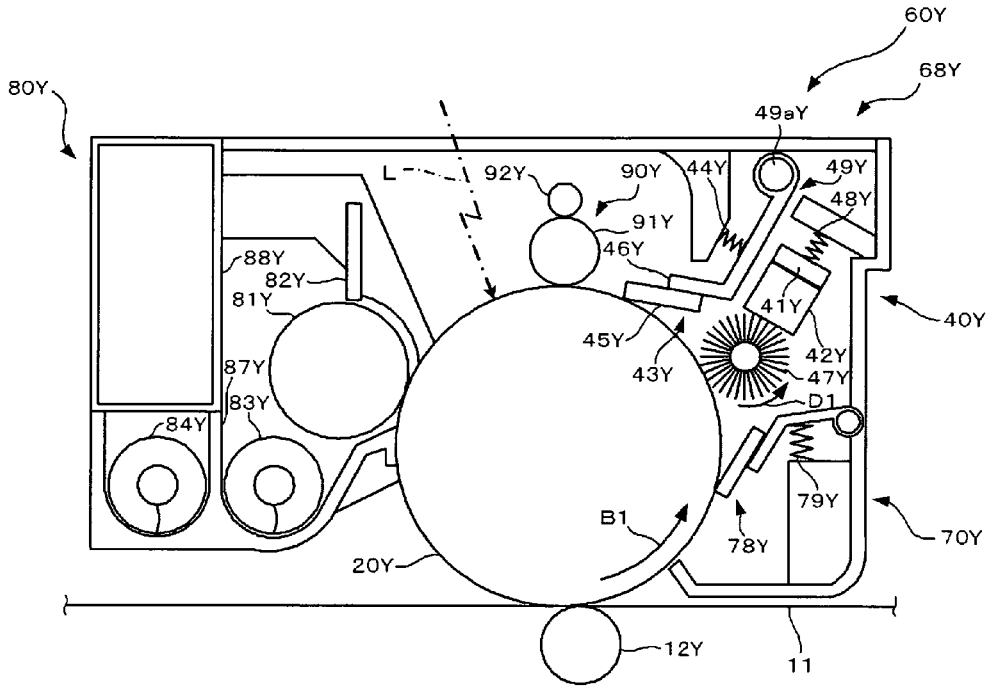
FIG. 2 is a schematic elevation of the configuration around one of the image bearing members contained in the image forming apparatus illustrated in FIG. 1.

As illustrated in FIG. 2, the image forming unit 60Y containing the photoconductor drum 20Y has, around the photoconductor drum 20Y, a primary transfer roller 12Y, a cleaning device 70Y (drum cleaning device serving as a cleaning unit), a protecting film-forming device 40Y (protecting agent-supplying device (protecting film-forming unit)), an unillustrated charge-eliminating device, a charging device 90Y (serving as a charging unit) and a developing device 80Y (a developing device serving as a developing unit). These members are disposed so as to face the photoconductor drum 20Y along the B1 direction (in which the photoconductor drum 20Y is rotated); i.e., counterclockwise in the figure. The protecting film-forming device is a protecting agent-applying unit configured to apply a protecting agent 42Y (image bearing member-protecting agent) to the photoconductor drum 20Y. The charge-eliminating device has a charge-eliminating lamp.

The photoconductor drum 20Y, the cleaning device 70Y, the protecting film-forming device 40Y, the charge-eliminating device, the charging device 90Y and the developing device 80Y are integrally provided so as to form a process cartridge 68Y. The process cartridge 68Y is detachable to the main body 99. In this manner, when the members are provided in the form of the process cartridge which can be used as a replacement part, the maintenance thereof can be remarkably easily performed, which is quite preferred.

The photoconductor drum 20Y has a conductive support and a photoconductive layer thereon; i.e., an OPC photoconductor having an organic photoconductive layer. The detail description thereof will be given below.

The cleaning device 70Y has a cleaning blade 78Y, a spring 79Y and an unillustrated recovering chamber along the direction indicated by arrow B1. The cleaning blade is a cleaning member which is disposed downstream of the position where the toner image on the photoconductor drum 20Y is transferred onto the transfer belt 11 by the primary transfer roller 12Y but upstream of the position where a protecting agent 42Y is supplied from the protecting film-forming device 40Y. The tip of the cleaning blade is brought into contact with the photoconductor drum 20Y so as to scrape off (remove) toner particles remaining after transfer on the photoconductor drum 20Y and foreign matters (e.g., carriers and paper dust) thereon for cleaning. The spring causes the cleaning blade to be pressed against the photoconductor drum 20Y using a predetermined elastic force. The recovering chamber recovers the post-transfer residual toner particles or other foreign matters which have been removed by the cleaning blade 78Y from the photoconductor drum 20Y.

The cleaning blade 78Y is brought into contact with the photoconductor drum 20Y at an angle related to a so-called counter type (reading type).

The charging device 90Y is a charging unit configured to uniformly charge a surface of the photoconductor drum 20Y. The charging device 90Y has a charging roller 91Y, a cleaning roller 92Y and an unillustrated high-voltage power source. The charging roller is a charging member which is disposed closely to the surface of the photoconductor drum 20Y. The cleaning roller is disposed so as to come into contact with the charging roller 91Y, and cleans the charging roller 91Y. The high-voltage power source is a voltage-applying unit configured to apply to the charging roller 91Y a voltage which is formed by superposing a direct-current voltage on an alternating-current voltage, so that the voltage contains a direct-current component and an alternating-current component.

The method of charging the photoconductor drum 20Y may be, for example, a method by charging the photoconductor drum using the charging roller 91Y disposed close to the photoconductor drum 20Y (close-contact charging method) (like the charging device 90Y in this embodiment) and a method by charging the photoconductor drum using such a charging member as the charging roller 91Y disposed so as to come into contact with the photoconductor drum 20Y (contact-charging method (contact method)). The high-voltage power supply may be that applying only a direct-current voltage to the charging roller 91Y.

The charging device 90Y charges the photoconductor drum 20Y through discharge within a small gap between the charging roller 91Y and the photoconductor drum 20Y upon application of voltage with the high-voltage power supply. As compared with dischargers based on corona discharge using a discharging wire (e.g., so-called corotron and scorotron), the above charging method considerably reduces the amount of ozone generated during charging.

The light-scanning device 8 writes a latent electrostatic image in response to image information of a visible yellow image to be formed by the developing device 80Y. To form the latent electrostatic image, the light-scanning device applies modulated/polarized laser light L to a region between the charging region (where the charging device 90Y faces the photoconductor drum 20Y) and the developing region (where the developing device 80Y faces the photoconductor drum), to thereby expose, through spot irradiation, the surface of the photoconductor drum 20Y having been charged by the charging device 90Y. The light-scanning device 8, as illustrated in FIG. 1, has a light source 31, a polygon mirror 32 (which is a polygon column rotating at high speed), a lens fθ 33, a reflective mirror 34, etc.

As illustrated in FIG. 2, the developing device 80Y has a developing roller 81Y (which is disposed close to the photoconductor drum 20Y so as to face the photoconductor drum), a doctor blade 82Y (which adjusts the thickness of the developer on the developing roller 81Y to a certain thickness), a first feeding screw 83Y and a second feeding screw 84Y (which are disposed so as to face each other and stir and feed a developer to the developing roller 81Y), a partition wall 87Y (which is disposed between the first feeding screw 83Y and the second feeding screw 84Y), a toner bottle 88Y containing yellow toner, an unillustrated bias-applying unit (which is configured to apply to the developing roller 81Y a developing bias of direct-current component).

The developing roller 81Y has an unillustrated developing sleeve which is a developer carrier carrying a developer on a surface thereof. The bias-applying unit is configured to apply, to the developing sleeve, an appropriate amount of a developing bias corresponding to the difference between exposed portions and unexposed portions on the photoconductor drum 20Y.

The developing device 80Y is divided by a partition wall 87Y into a first feeding part and a second feeding part. The first feeding part houses the developing roller 81Y and the first feeding screw 83Y. The second feeding screw houses the second feeding screw 84Y.

While being rotated with a driving unit, the first feeding screw 83Y feeds the developer contained in the first feeding part to the developing roller 81Y from the back to the front of FIG. 2. The developer is fed by the first feeding screw 83Y to the position near the edge of the first feeding part, and then, enters the second feeding part through an unillustrated opening formed in the partition wall 87Y.

In the second feeding part, the second feeding screw 84Y feeds the developer, which has been fed from the first feeding part by the first feeding screw being rotated with the driving unit, in a direction opposite to the direction in which the developer is fed by the first feeding screw 83Y. The developer is fed to a position near the edge of the second feeding part by the second feeding screw 84Y, and then, is returned to the first feeding part through another unillustrated opening formed in the partition wall 87Y.

The developer contained in a developer case 85Y is a two-component developer containing magnetic carriers and yellow toner particles. The yellow toner particles are added/supplied from the toner bottle 88Y to the developer. The thus-supplied yellow toner particles and the developer are transferred under mixing/stirring by the first feeding screw 83Y and the second feeding screw 84Y. As a result, the toner particles and the developer are frictionally charged and fed/carried onto the developing roller 81Y.

The developing roller 81Y, after the amount of the developer carried thereon (the thickness of a layer of the developer) has been controlled by the doctor blade 82Y, conveys an appropriate amount of the developer to the developing region between the developing roller 81Y and the photoconductor drum 20Y in accordance with the rotation thereof. Then, through the application of developing bias generated by the bias-applying unit, the yellow toner particles contained in the developer are electrically transferred onto a latent electrostatic image formed on the photoconductor drum 20Y, to thereby form a yellow toner image corresponding to the latent electrostatic image.

The developer in which the yellow toner has been consumed after development is returned to the developing device 80Y in accordance with the rotation of the developing roller 81Y.

In this embodiment, a developing bias of direct-current component is applied with the bias-applying unit. But, the developing bias may be an alternating current component or a superposed direct-current component/alternating current component.

The protecting film-forming device 40Y has a protecting agent 42Y and a brush roller 47Y. The protecting agent is a solid lubricant molded in the form of a bar. The brush roller is a fur brush (scraping member) which is a protecting agent feeding member. The protecting agent feeding member is a feeding member which scrapes off and feeds the protecting agent 42Y to the photoconductor drum 20Y for protecting the photoconductor drum 20Y.

The protecting film-forming device 40Y also has a holder 41Y, a spring 48Y and a protecting layer-forming mechanism 49Y. Here, the holder supports the protecting agent 42Y at a surface facing the photoconductor drum 20Y and at the other surface. The spring is a pressing spring (press force-applying mechanism). The pressing spring is an elastic member which presses the protecting agent 42Y against the brush roller 47Y via the holder 41Y. The protecting layer-forming mechanism is for forming a protective film by coating the photoconductor drum 20Y with the protecting agent 42Y which has been supplied by the brush roller 47Y to the photoconductor drum 20Y.

In order for the protecting agent 42Y to be scraped off and consumed by the brush roller 47Y uniformly as a whole in the width direction, the protecting agent 42Y and the brush roller 47Y have the same length in the direction perpendicular to the front surface of FIG. 2 (i.e., in the width direction), and are disposed over the same region in the width direction. Also, the spring 48Y is adjusted so as to press the protecting agent 42Y against the brush roller 47Y at a constant press force over time and a uniform pressure in the longitudinal direction.

The protecting agent 42Y and the brush roller 47Y each have a length (in the width direction) equal to or larger than the length (in the width direction) of the image forming region of the photoconductor drum 20Y. In the width direction, the protecting agent 42Y and the brush roller 47Y are disposed so as to contain the image forming region of the photoconductor drum 20Y. With this configuration, the protecting agent 42Y is supplied by the brush roller 47Y to the image forming region of the photoconductor drum 20Y uniformly in the width direction.

The protecting film-forming mechanism 49Y has a coating blade 43Y and a spring 44Y. The coating blade is a film-forming member (layer-forming member) which comes into contact with the photoconductor drum 20Y at the end thereof, to layer, on the photoconductor drum 20Y, the protecting agent 42Y supplied by the brush roller 47Y to the photoconductor drum 20Y. The spring is an elastic member which presses the coating blade 43Y against the photoconductor drum 20Y at a predetermined elastic force.

The coating blade 43Y has a blade 45Y and a blade support 46Y. The blade support comes into contact with the photoconductor drum 20Y. The blade support is rotatable around a support shaft 49*a*Y and supports the blade 45Y. Also, the blade support is pressed by the spring 44Y. The blade 45Y and the blade support 46Y are attached to each other through adhesion, in order to ensure pressing of the end of the blade 45Y against the photoconductor drum 20Y. Alternatively, these members may be attached to each other through any other means such as fusion.

The length (in the width direction) of the coating blade 43Y is equal to or larger than the length (in the width direction) of the image forming region of the photoconductor drum 20Y. The coating blade is disposed so as to contain the image forming region of the photoconductor drum 20Y. With this configuration, the coating blade 43Y uniformly comes into contact with at least the image forming region of the photoconductor drum 20Y in the width direction, and forms a uniform film on at least the image forming region of the photoconductor drum 20Y in the width direction.

The protecting film-forming device 40Y having the above-described configuration supplies the protecting agent 42Y to the photoconductor drum 20Y as follows. Specifically, the brush roller 47Y is rotated around the axis thereof at a predetermined linear velocity different from the rotation speed of the photoconductor drum 20Y in the direction indicated by D1, which is the counter direction with respect to the rotation direction B1 of the photoconductor drum 20Y. The brush roller scrapes off and holds/transfers the protecting agent 42Y to the position where the brush roller comes into contact with the surface of the photoconductor drum 20Y.

Although the protecting agent 42Y applied to the photoconductor drum 20Y may not form a sufficient protecting film on the photoconductor drum 20Y depending on the material of the protecting agent 42Y, the protecting agent is pressed by the coating blade 43Y against the surface of the photoconductor drum 20Y and is stretched thereon, whereby a thin layer (film) of the protecting agent is formed (in other words, the protecting agent is layered). In this manner, a film of the protecting agent is formed assuredly and uniformly.

Even when the protecting agent 42Y is scraped off by the brush roller 47Y and reduced over time (i.e., the protecting agent 42Y becomes small), the brush roller 47Y scrapes off and feeds an appropriate amount of the protecting agent to the photoconductor drum 20Y. This is because the spring 48Y uniformly presses the protecting agent 42Y against the brush roller 47Y at a constant pressure over time in the longitudinal direction.

The film of the protecting agent 42Y formed on the surface of the photoconductor drum 20Y has a function of preventing degradation of the surface of the photoconductor drum 20Y due to contact discharging. Thus, the protecting film-forming device 40Y serves as a unit configured to prevent degradation due to discharging. Here, "degradation" refers both to abrasion of the photoconductor drum 20Y due to discharging and acceleration of the abrasion, and to activation of the surface of the photoconductor drum 20Y.

Also, this film prevents degradation such as abrasion due to the friction between the photoconductor drum 20Y and the cleaning blade 78Y, and degradation due to filming (caused by the friction) on the surface of the photoconductor drum 20Y. Thus, the protecting film-forming device 40Y serves as a unit configured to prevent degradation due to friction.

As described above, the protecting film-forming device 40Y applies the protecting agent 42Y onto the surface of the photoconductor drum 20Y, to thereby prevent such degradations.

Other detail descriptions of the protecting film-forming device 40Y will be given below.

In the above-described image forming-unit 60Y, image formation is performed through a nega-posi process. While the photoconductor drum 20Y is being rotated in the B1 direction, the surface thereof is uniformly negative-charged by the charging device 90Y. Then, the surface is scanned by/exposed to laser light L emitted from the light-scanning device 8 to form a latent electrostatic image of yellow. In this state, the photoconductor drum 20Y is scanned/exposed along the rotation axis thereof. Also, the absolute value of the potential at the exposed portion is lower than the absolute value of the potential at the unexposed portion.

The latent electrostatic image is developed by the developing device 80Y with yellow toner contained in the developer. The yellow toner image obtained after development is primarily transferred by the primary transfer roller 12Y onto the transfer belt 11 moving in the A1 direction. The post-transfer toner particles (remaining after transfer) are removed by the cleaning device 70Y. Then, the protecting film-forming device 40Y feeds the protecting agent 42Y. After that, the residual charges are eliminated by the charge-eliminating device. The photoconductor drum is subjected to the next charging (charge-eliminating) by the charging device 90Y.

In this state, the cleaning device 70Y removes the partially or entirely degraded protecting agent on the photoconductor drum 20Y, in addition to other matters such as post-transfer residual toner particles.

The protecting film-forming device 40Y forms a protecting film of the protecting agent on the surface of the photoconductor drum 20Y having undergone cleaning.

The cleaning device 70Y may be omitted by imparting its function (cleaning function) to the protecting layer-forming mechanism 49Y or the coating blade 43Y contained therein.

However, a member having the function of cleaning the photoconductor drum 20Y and a member having the function of forming a protective layer are different in material, required press force (against the photoconductor drum 20Y) and preferable contact state (with the photoconductor drum 20Y). Thus, as in this embodiment, preferably, these members are provided as separate members rather than as a single member. Specifically, in the B1 direction, the cleaning device 70Y is disposed upstream and the protecting layer-forming mechanism 49Y is disposed downstream, which is a preferred embodiment. Notably, also in this embodiment, since the cleaning device 70Y cleans the protecting agent on the surface of the photoconductor drum 20Y, the cleaning device is regarded as a protecting agent-cleaning mechanism, which is a protecting agent-cleaning unit contained in the protecting film-forming device 40Y.

Similarly, toner images of the other colors are correspondingly formed on the other photoconductor drums 20M, 20C and 20BK, and then primarily transferred sequentially by the primary transfer rollers 12M, 12C and 12BK onto the same position of the transfer belt 11 moving in the A1 direction. While the transfer belt 11 is rotated in the A1 direction, the composite toner image formed on the transfer belt 11 is moved to the secondary transfer nip where the secondary transfer roller 5 faces the transfer belt. In this nip, the composite image adheres closely to a recording paper, and is secondarily transferred thereonto by the secondary transfer bias or the nip pressure, whereby a full color image is formed on the recording paper.

After has been fed to between the transfer belt 11 and the secondary transfer roller 5, the recording paper is fed by a paper-feeding roller 3 from the sheet-feeding device 61. Then, based on detection signals obtained by the sensor, the recording paper is fed by the registration rollers 4 at the timing when the top end of the toner image on the transfer belt 11 faces the secondary transfer roller 5.

With the bias-applying unit, a potential having the opposite portability to that of the toner is applied to the secondary transfer roller 5.

The toner images of all colors are transferred/carried onto the recording paper. Then, the recording paper enters the fixing device 6 where the toner image is fixed thereon by the action of heat and pressure applied when the recording paper passes between the press roller 63 and the belt unit 62, whereby a full color image is fixed on the recording paper. The fixed recording paper, having passed through the fixing device 6, passes between the discharging rollers 7 and is stacked on the discharge tray 17 located above the main body 99. The surface of the transfer belt 11, having passed through the secondary transfer nip after secondary transfer, is cleaned by a cleaning brush and a cleaning blade equipped with the cleaning device 13 for the next developing step.

The protecting film-forming device 40Y will be described below. Notably, this protecting film-forming device has the same configuration as the other protecting film-forming devices contained in the image forming units 60M, 60C and 60BK. Thus, the description of the other protecting film-forming devices is omitted.

As described above, since the protecting film-forming device 40Y has the spring 48Y, the brush roller 47Y scrapes off and feeds an appropriate amount of the protecting agent 42Y to the photoconductor drum 20Y through contact therewith, even when the protecting agent 42Y is scraped off by the brush roller 47Y and reduced over time (i.e., the protecting agent becomes small).

Even when small and spherical toner particles described below are used, the amount of the protecting agent 42Y applied to the surface of the photoconductor drum 20Y is maintained to prevent filming on the surface of the photoconductor drum 20Y and maintain protective performance on the surface of the photoconductor drum 20Y. Specifically, the protecting agent 42Y of the protecting film-forming device 40Y contains a fatty acid zinc salt, and is supplied to the surface of the photoconductor drum 20Y so that the amount of the protecting agent 42Y satisfies, on the basis of the amount of Zn present on the surface of the photoconductor drum 20Y, the relation $0.4 \leqq Zn \leqq 2.5$ (Atomic %).

Also, the protecting agent 42Y further contains boron nitride (which is an inorganic lubricant) in addition to the fatty acid zinc salt. Thus, even when affected due to discharge in the charging step, this protecting agent is decreased in lubricity to a less extent than in the protecting agent containing a fatty acid metal salt as a main component. In addition, the protecting agent prevents the below-described small/highly spherical toner particles from running through the cleaning blade 78Y to stain the charging roller 91Y or adversely affect the formed images, and also suppresses or prevents the cleaning blade 78Y from being abraded. Furthermore, the protecting agent 42Y is suppressed or prevented from running, together with toner particles, through the cleaning blade 78Y to stain the charging roller 91Y.

However, the studies of the present inventors have revealed that, when the protecting agent 42Y is supplied to the surface of the photoconductor drum 20Y, image formation can be affected depending on the amount of boron present on the surface of the photoconductor drum 20Y. That is, when the amount of boron is large, boron is deposited on the surface of the photoconductor drum 20Y to cause filming, which can adversely affect image formation. Whereas when the amount of boron is small, the protecting agent 42Y containing boron nitride may not achieve the above-described functions.

In view of this, the protecting film-forming device 40Y feeds the protecting agent 42Y to the surface of the photoconductor drum 20Y so as to satisfy, on the basis of the amount of zinc (Zn) present on the surface of the photoconductor drum 20Y, the relation $0.4 \leqq Zn \leqq 2.5$ (Atomic %) as described above, and to also satisfy, on the basis of the amount of boron (B) present on the surface of the photoconductor drum 20Y, the relation $0.2 \leqq B \leqq 30.2$ (Atomic %). The grounds for the above numerical ranges are clearly shown in Examples and Comparative Examples as described below. The amount of the protecting agent 42Y supplied to the surface of the photoconductor drum 20Y is adjusted by controlling the ratio between the fatty acid zinc salt and boron nitride in the protecting agent 42Y, the hardness of the protecting agent 42Y, the configuration of the brush roller 47Y, the rotation speed, and the press force of the spring 48Y.

Typical examples of the fatty acid zinc salt include, but not limited to, zinc stearate, zinc oleate, zinc palmitate, zinc linolenate, zinc caprate, zinc laurate, zinc enanthate, zinc montanate and mixtures thereof. These fatty acid zinc salts may be used in combination. Most preferably, the fatty acid zinc salt contains zinc stearate from the viewpoint of exhibiting good protection property of the photoconductor drum 20Y. In addition, stearic acid is the cheapest of higher fatty acids, and zinc stearate is a very stable compound excellent in hydrophobicity. Thus, the protecting agent 42Y contains zinc stearate.

Boron nitride is an inorganic lubricant characterized by its two-dimensional structure, and is a compound having layers bonded to each other by only Van der Waals force. Each of the layers is formed through metal bonds, covalent bonds or ion bonds. As described above, when the protecting agent 42Y contains boron nitride, the lubricity between the photoconductor drum 20Y and the cleaning blade 78Y is considerably improved to prevent (suppress) toner particles and the protecting agent 42Y from running through the cleaning blade. As a result, the charging roller 91Y is prevented (suppressed) from being stained.

Here, the protecting agent 42Y is a solid lubricant molded in the form of a bar as described above. Examples of known methods for forming the protecting agent 42Y so as to have a block shape include compression molding and melt molding. The protecting agent 42Y may be molded by any method. Both compression molding and melt molding mold a mixture of powder of the below-described components of the protecting agent 42Y. In the former molding, the powder mixture is charged into a mold and then pressed by a press machine, to thereby form the protecting agent 42Y as a block-shaped solid product. In the latter molding, the powder mixture is melted and poured into a mold, followed by cooling, to thereby form the protecting agent 42Y as a block-shaped solid product.

The material of the blade 45Y is not particularly limited. Examples of the material include elastic materials such as urethane rubber, hydrin rubber, silicone rubber and fluorine rubber, which are generally known as materials for cleaning blades. These elastic materials may be used individually or in a blended manner. Additionally, a portion of such a rubber blade which comes into contact with the photoconductor drum 20Y may be coated or impregnated with a low-friction-coefficient material. Further, in order to adjust the hardness of the elastic material used, a filling material such as an organic or inorganic filler may be dispersed.

Although the thickness of the blade 45Y cannot be unequivocally defined because the thickness is decided in view of the force applied by the spring 44Y, the blade preferably has a thickness of about 0.5 mm to about 5 mm, more preferably about 1 mm to about 3 mm.

Similarly, although the length of the blade 45Y which protrudes from the blade support 46Y and may bend (so-called free length) cannot be unequivocally defined because the length is decided in view of the force applied by the spring 44Y, the length is preferably about 1 mm to about 15 mm, more preferably about 2 mm to about 10 mm.

Another structure of the coating blade 43Y may be employed in which a layer of a resin, rubber, elastomer, etc. is formed over a surface of an elastic metal blade such as a spring plate, using a coupling agent, a primer component, etc. if necessary, by a method such as coating or dipping, then subjected to thermal curing, etc. if necessary, and further, subjected to surface polishing, etc. if necessary.

In this case, the thickness of the elastic metal blade is preferably about 0.05 mm to about 3 mm, more preferably about 0.1 mm to about 1 mm.

In order to prevent the elastic metal blade from being twisted, the blade may, for example, be bent in a direction substantially parallel to the support shaft 49*a*Y after the installation of the blade.

As the material for the layer over the surface, a fluorine resin such as PFA, PTFE, FEP or PVdF, a fluorine-based rubber, a silicone-based elastomer such as methylphenyl silicone elastomer, or the like may be used with the addition of a filler if necessary. However, the material is not limited thereto.

The force with which the photoconductor drum 20Y is pressed by the blade 45Y may be the force with which the protecting agent 42Y is spread and form into a protective layer or a protective film. The force is preferably 5 gf/cm to 80 gf/cm, more preferably 10 gf/cm to 60 gf/cm, as a linear pressure.

In order to reduce mechanical stress of the brush roller 47Y on the surface of the photoconductor drum 20Y, brush fibers of the brush roller preferably have flexibility.

As the material for the flexible brush fibers, one or more generally known materials may be used.

Specifically, resins having flexibility among the following materials may be used: polyolefin resins (e.g., polyethylene and polypropylene); polyvinyl resins and polyvinylidene resins (e.g., polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones); vinyl chloride-vinyl acetate copolymers; styrene-acrylic acid copolymers; styrene-butadiene resins; fluorine resins (e.g., polytetrafluoroethylene, polyvinyl fluoride, polyvinylidene fluoride and polychlorotrifluoroethylene); polyesters; nylons; acrylics; rayon; polyurethanes; polycarbonates; phenol resins; amino resins (e.g. urea-formaldehyde resins, melamine resins, benzoguanamine resins, urea resins and polyamide resins); and so forth.

To adjust the extent to which the brush bends, diene-based rubber, styrene-butadiene rubber (SBR), ethylene propylene rubber, isoprene rubber, nitrile rubber, urethane rubber, silicone rubber, hydrin rubber, norbornene rubber and the like may be used in combination.

The support immobilizing the brush fibers at their bases is a rotatable roll-like support. To form the brush roller 47Y, the rotatable roll-like support is spirally wound by a tape with a pile of brush fibers around a metal core. Notably, this support may be a stationary support.

Each brush fiber preferably has a diameter of about 10 μm to about 500 μm and a length of 1 mm to 15 mm, and the number of the brush fibers is preferably 10,000 to 300,000 per square inch ($1.5\times10^7$ to $4.5\times10^8$ per square meter).

For the brush roller 47Y, use of a material having a high brush fiber density is highly desirable in terms of uniformity and stability of the supply; for example, it is desirable that one fiber be formed from several to several hundreds of fine fibers. More specifically, 50 fine fibers of 6.7 decitex (6 denier) may be bundled together and planted as one fiber, as exemplified by the case of 333 decitex=6.7 decitex×50 filaments (300 denier=6 denier×50 filaments).

Additionally, if necessary, the surface of the brush roller 47Y may be provided with a coating layer for the purpose of stabilizing the shape of the brush surface, the environment, etc. As component(s) of the coating layer, use of component(s) capable of deforming in a manner that conforms to the bending of the brush fibers is preferable, and the component(s) is/are not limited in any way as long as it/they can maintain its/their flexibility. Examples of the component(s) include polyolefin resins such as polyethylene, polypropylene, chlorinated polyethylene and chlorosulfonated polyethylene; polyvinyl resins and polyvinylidene resins, such as polystyrene, acrylics (e.g., polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g., modified products made of alkyd resins, polyester resins, epoxy resins, polyurethanes, etc.); fluorine resins such as perfluoroalkyl ethers, polyfluorovinyl, polyfluorovinylidene and polychlorotrifluoroethylene; polyamides; polyesters; polyurethanes; polycarbonates; amino resins such as urea-formaldehyde resins; epoxy resins; and combinations of these resins.

The structure of the photoconductor drum 20Y will be described in detail. Notably, this photoconductor drum has the same structure as the other photoconductor drums 20M, 20C and 20BK contained in the image forming units 60M, 60C and 60BK. Thus, the description of the other photoconductor drums 20M, 20C and 20BK is omitted.

The photoconductor drum 20Y includes a conductive support, and a photoconductive layer provided on the conductive support.

The structure of the photosensitive layer is selected from a single-layer structure in which a charge generating material and a charge transporting material are present in a mixed manner, a normal layer structure in which a charge transporting layer is provided on a charge generating layer, and an inverted layer structure in which a charge generating layer is provided on a charge transporting layer.

Additionally, a protecting layer may be provided on the photosensitive layer as the uppermost surface, in order to improve the mechanical strength, abrasion resistance, gas resistance, cleanability, etc. of the photoconductor drum 20Y. Further, an underlying layer may be provided between the photoconductive layer and the conductive support. Also, if necessary, an appropriate amount of a plasticizer, an antioxidant, a leveling agent, etc. may be added to each layer.

As the conductive support, what can be used is a material exhibiting conductivity of $10^{10}$ Ω·cm or less in volume resistance. Examples thereof include a construction formed by coating a film-like or cylindrical piece of plastic or paper with a metal such as aluminum, nickel, chrome, Nichrome, copper, gold, silver or platinum or with a metal oxide such as tin oxide or indium oxide by means of vapor deposition or sputtering; a plate of aluminum, aluminum alloy, nickel, stainless, etc.; and a tube produced by forming the plate into a drum-shaped mother tube by means of drawing, extrusion, etc. and then surface-treating the mother tube by means of cutting, superfinishing, polishing, etc.

The conductive support has a drum shape whose diameter is 20 mm to 150 mm, preferably 24 mm to 100 mm, more preferably 28 mm to 70 mm. If the drum-shaped conductive support has a diameter of 20 mm or less, it is physically difficult to place, around the photoconductor drum 20Y, members for the steps of charging, exposing, developing, transferring and cleaning. If the drum-shaped conductive support has a diameter of 150 mm or greater, it is undesirable because the image forming apparatus 100 is enlarged.

Particularly in the case where an image forming apparatus is of tandem type like the image forming apparatus 100 in this embodiment, it is necessary to install a plurality of photoconductor drums therein, so that the diameter of the support of each photoconductor drum is preferably 70 mm or less, more preferably 60 mm or less. Parenthetically, the endless nickel belt and the endless stainless steel belt disclosed in JP-A No. 52-36016 can be used as conductive supports.

Examples of the underlying layer of the photoconductor drum include a layer composed mainly of resin, a layer composed mainly of white pigment and resin, and an oxidized metal film obtained by chemically or electrochemically oxidizing the surface of a conductive support, with a layer composed mainly of white pigment and resin being preferred. Examples of the white pigment include metal oxides such as titanium oxide, aluminum oxide, zirconium oxide and zinc oxide. Among them, it is most desirable to use titanium oxide that is superior in preventing penetration of electric charge from the conductive support. Examples of the resin used for the underlying layer include thermoplastic resins such as polyamide, polyvinyl alcohol, casein and methyl cellulose, and thermosetting resins such as acrylics, phenol resins, melamine resins, alkyds, unsaturated polyesters and epoxies. These may be used individually or in combination.

Examples of the charge generating material include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used individually or in combination. The underlying layer may have a single-layer structure or a multilayer structure.

Examples of the charge transporting material include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used individually or in combination.

Binder resin(s) used in forming the photoconductive layer composed of the charge generating layer and the charge transporting layer is/are electrically insulative and may be selected from known thermoplastic resins, thermosetting resins, photocurable resins, photoconductive resins and the like. Suitable examples thereof include, but not limited to, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyesters, phenoxy resins, (meth)acrylic resins, polystyrene, polycarbonates, polyarylate, polysulphone, polyethersulphone and ABS resins; thermosetting resins such as phenol resins, epoxy resins, urethane resins, melamine resins, isocyanate resins, alkyd resins, silicone resins and thermosetting acrylic resins; and photoconductive resins such as polyvinylcarbazole, polyvinylanthracene and polyvinylpyrene. These may be used individually or in combination.

Examples of the antioxidant include the following compounds.

[Monophenolic Compounds]

2,6-di-t-butyl-p-cresol, butylated hydroxyanisole, 2,6-di-t-butyl-4-ethylphenol, stearyl-β-(3,5-di-t-butyl-4-hydroxyphenyl)propionate, 3-t-butyl-4-hydroxyanisole and so forth

[Bisphenolic Compounds]

2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) and so forth

[Polymeric Phenolic Compounds]

1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocophenols and so forth

[p-Phenylenediamines]

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine and so forth

[Hydroquinones]

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and so forth

[Organic Sulfur Compounds]

dilauryl-3,3'-thiodipropionate, distearyl-3,3'-thiodipropionate, ditetradecyl-3,3'-thiodipropionate and so forth

[Organic Phosphorus Compounds]

triphenylphosphine, tri(nonylphenyl)phosphine, tri(dinonylphenyl)phosphine, tricresylphosphine, tri(2,4-dibutylphenoxy)phosphine and so forth For the plasticizer, a resin such as dibutyl phthalate or dioctyl phthalate generally used as a plasticizer can be used without the need to change it in any way. It is appropriate that the amount of the plasticizer used be 0 parts by mass to 30 parts by mass per 100 parts by mass of the binder resin.

A leveling agent may be added into the charge transporting layer. Examples of the leveling agent include silicone oils such as dimethyl silicone oil and methylphenyl silicone oil; and polymers or oligomers having perfluoroalkyl groups in their side chains. It is appropriate that the amount of the leveling agent used be 0 parts by mass to 1 part by mass per 100 parts by mass of the binder resin.

As described above, the surface layer is provided in order to improve the mechanical strength, abrasion resistance, gas resistance, cleanability, etc. of the photoconductor drum 20Y. Examples of the material for the surface layer include a polymer, and a polymer with an inorganic filler dispersed therein, both of which have greater mechanical strength than the photosensitive layer. The polymer used for the surface layer may be a thermoplastic polymer or a thermosetting polymer, with a thermosetting polymer being preferred because it has high mechanical strength and is highly capable of reducing abrasion caused by friction with a cleaning blade. For this reason, the surface layer in this embodiment contains a thermosetting polymer. As long as the surface layer is thin, there may be no problem if it does not have charge transporting capability. However, when a surface layer not having charge transporting capability is formed so as to be thick, the photoconductor is easily caused to decrease in sensitivity, increase in electric potential after exposure, and increase in residual potential, so that it is desirable to mix the above-mentioned charge transporting material into the surface layer or use a polymer with charge transporting capability for the surface layer.

Generally, the photosensitive layer and the surface layer greatly differ from each other in mechanical strength, so that once the surface layer is abraded due to friction with the cleaning blade 78Y and thusly disappears, the photosensitive layer is also abraded. Therefore, when the surface layer is provided, it is important to make it have a sufficient thickness. The thickness of the surface layer is 0.01 μm to 12 μm, preferably 1 μm to 10 μm, more preferably 2 μm to 8 μm. If the thickness of the surface layer is less than 0.01 μm, it is not desirable because the surface layer is so thin that parts of the surface layer easily disappear due to friction with the cleaning blade 78Y, and abrasion of the photosensitive layer progresses through the missing parts. If the thickness of the surface layer is greater than 12 μm, it is not desirable because the photoconductor is easily caused to decrease in sensitivity, increase in electric potential after exposure, and increase in residual potential and, especially when a polymer with charge transporting capability is used, the cost of the polymer increases.

As the polymer used for the surface layer, a polymer which is transparent to writing light at the time of image formation and superior in insulation, mechanical strength and adhesiveness is desirable. Examples thereof include resins such as ABS resins, ACS resins, olefin-vinyl monomer copolymers, chlorinated polyethers, allyl resins, phenol resins, polyacetals, polyamides, polyamide-imides, polyacrylates, polyallylsulfones, polybutylene, polybutylene terephthalate, polycarbonates, polyethersulfones, polyethylene, polyethylene terephthalate, polyimides, acrylic resins, polymethylpentene, polypropylene, polyphenylene oxide, polysulfones, polystyrene, AS resins, butadiene-styrene copolymers, polyurethanes, polyvinyl chloride, polyvinylidene chloride and epoxy resins. The polymer exemplified by these may be a thermoplastic polymer; however, when a thermosetting polymer produced by cross-linkage with a multifunctional cross-linking agent having an acryloyl group, carboxyl group, hydroxyl group, amino group, etc. is used as the polymer to enhance its mechanical strength, the surface layer increases in mechanical strength and it becomes possible to greatly reduce abrasion caused by friction with the cleaning blade.

As described above, the surface layer preferably has charge transporting capability. In order for the surface layer to have charge transporting capability, it is possible to employ a method in which a polymer used for the surface layer and the aforementioned charge transporting material are mixed together, or a method in which a polymer having charge transporting capability is used as the surface layer, with the latter method being preferable because a photoconductor which is highly sensitive and does not increase much in electric potential after exposure or in residual potential can be obtained.

The toner which can be used in the image forming apparatus 100 is not particularly limited and may be appropriately selected among known toners.

EXAMPLES

Example

The present invention will next be described in detail by way of Examples, which should not be construed as limiting the present invention thereto.

(Usage Environment of Protecting Agent)

In the image forming part of IMAGIO MP C5000 (product of Ricoh, Company Ltd.) or IMAGIO MP C3000 (product of Ricoh, Company Ltd.), a protecting agent was supplied, instead of zinc stearate originally used in the apparatus, from a portion for the supply of zinc stearate so as to satisfy the below-described conditions of Examples and Comparative Examples.

And, a protecting agent-supplying device having the same configuration as the protecting film-forming device 40Y in the above embodiment was disposed upstream of a cleaning member provided therein (corresponding to the cleaning blade 78Y, etc. in the above embodiment) along the rotational direction of an image bearing member provided therein (corresponding to the photoconductor drum 20Y, etc. in the above embodiment).

The amount of the protecting agent supplied to the image bearing member was adjusted by changing the press force of the protecting agent against a supplying member (corresponding to the brush roller 47Y in the above embodiment) with a member (corresponding to the spring 48Y in the above embodiment) provided in the protecting agent-supplying device. Notably, the press force is generally 2.5 N to 3 N.

(Protecting Agent)

Zinc stearate contained in the protecting agent is available from NOF CORPORATION.

Boron nitride contained in the protecting agent is available from Momentive Performance Materials Inc.

In the following Examples and Comparative Examples, the protecting agent was applied to the surface of the image bearing member so as to satisfy, on the basis of the amount of Zn present thereon, the relation $0.4 \leqq Zn \leqq 2.5$ (Atomic %).

(Usage Conditions of Protecting Agent and Measurement of the Amount of Zinc Present on the Surface of Image Bearing Member)

Using an A4 size belt chart having parts of an image occupation rate of 0% to 100%, 1,000,000 paper sheets were continuously printed out for the test. Notably, it is known that the amount of each element present on the image bearing member surface is saturated when 100 paper sheets are continuously printed out.

After the test, in the image forming part used for forming an image with an image occupation rate of 0% (non-image portion) or an image with an image occupation rate of 100% (solid image portion), the amount of zinc present on the image bearing member was measured twice through XPS, and the average of the measurements was used as the amount of zinc.

XPS was performed with K-ALPHA (product name) (product of Thermo Fischer Scientific K.K.).

The amount of boron was measured in the same manner as in the above measurement of the amount of zinc.

Example 1

In Example 1, the amount of zinc was adjusted to 2.5 atm % and the amount of boron 30.2 atm % on the surface of the image bearing member corresponding to the area with an image occupation rate of 0%. The amount of zinc was adjusted to 2.1 atm % and the amount of boron 23.9 atm % on the surface of the image bearing member corresponding to the area with an image occupation rate of 100%.

Example 2

In Example 2, the amount of zinc was adjusted to 2.3 atm % and the amount of boron 12.5 atm % on the surface of the image bearing member corresponding to the area with an image occupation rate of 0%. The amount of zinc was adjusted to 1.8 atm % and the amount of boron 7.8 atm % on the surface of the image bearing member corresponding to the area with an image occupation rate of 100%.

Example 3

In Example 3, the amount of zinc was adjusted to 1.0 atm % and the amount of boron 3.3 atm % on the surface of the image bearing member corresponding to the area with an image occupation rate of 0%. The amount of zinc was adjusted to 0.4 atm % and the amount of boron 1.2 atm % on the surface of the image bearing member corresponding to the area with an image occupation rate of 100%.

Example 4

In Example 4, the amount of zinc was adjusted to 1.9 atm % and the amount of boron 2.0 atm % on the surface of the image bearing member corresponding to the area with an image occupation rate of 0%. The amount of zinc was adjusted to 1.2 atm % and the amount of boron 0.9 atm % on the surface of the image bearing member corresponding to the area with an image occupation rate of 100%.

Example 5

In Example 5, the amount of zinc was adjusted to 1.2 atm % and the amount of boron 0.7 atm % on the surface of the image bearing member corresponding to the area with an image occupation rate of 0%. The amount of zinc was adjusted to 0.4 atm % and the amount of boron 0.2 atm % on the surface of the image bearing member corresponding to the area with an image occupation rate of 100%.

Example 6

The fatty acid zinc salt used in Example 6 was zinc myristate.

In Example 6, the amount of zinc was adjusted to 2.1 atm % and the amount of boron 6.8 atm % on the surface of the image bearing member corresponding to the area with an image occupation rate of 100%.

Example 7

In Example 7, the amount of zinc was adjusted to 2.1 atm % and the amount of boron 1.9 atm % on the surface of the image bearing member corresponding to the area with an image occupation rate of 100%.

Comparative Example 1

In Comparative Example 1, a protecting agent made of zinc stearate only was used. In Comparative Example 1, the amount of zinc was adjusted to 2.5 atm % and the amount of boron 0.0 atm % on the surface of the image bearing member corresponding to the area with an image occupation rate of 0%.

Comparative Example 2

In Comparative Example 2, the amount of zinc was adjusted to 1.7 atm % and the amount of boron 0.1 atm % on the surface of the image bearing member corresponding to the area with an image occupation rate of 0%.

Comparative Example 3

In Comparative Example 3, the amount of zinc was adjusted to 2.1 atm % and the amount of boron 33.0 atm % on the surface of the image bearing member corresponding to the area with an image occupation rate of 0%.

Comparative Example 4

In Comparative Example 4, the amount of zinc was adjusted to 0.2 atm % and the amount of boron 4.2 atm % on the surface of the image bearing member corresponding to the area with an image occupation rate of 100%.

After the above continuous printing test of 100 paper sheets, using again an A4 size belt chart having parts of an image occupation rate of 0% to 100%, 5,000 paper sheets were continuously printed out for the test. After this continuous printing test, in each Example and Comparative Example, the charging roller (i.e., a charging member corresponding to the charging roller 91Y in the above embodiment) provided in the above image forming part was visually observed for staining. In addition, the image bearing member was also visually observed for the degree of filming thereon. The results are shown in Table 1. In this table, the degree of staining of the charging roller is shown in the column indicated by "R staining," and the degree of the filming on the image bearing member is shown in the column indicated by "filming."

TABLE 1

| | | Ratio (ZnST:BN) | Press force | Image occupation rate of image forming part measured | Zn (Atm %) | B (Atm %) | R staining | Filming |
|---|---|---|---|---|---|---|---|---|
| Ex. 1 | C5000 | 6:4 | 3.5 | 0% | 2.5 | 30.2 | A | C |
| | C5000 | | 3.5 | 100% | 2.1 | 23.9 | A | B |
| Ex. 2 | C5000 | 7:3 | 3 | 0% | 2.3 | 12.5 | A | A |
| | C5000 | | 3 | 100% | 1.8 | 7.8 | A | A |
| Ex. 3 | C5000 | 7:3 | 2 | 0% | 1 | 3.3 | A | A |
| | C5000 | | 2 | 100% | 0.4 | 1.2 | A | C |
| Ex. 4 | C5000 | 9:1 | 3 | 0% | 1.9 | 2.0 | A | A |
| | C5000 | | 3 | 100% | 1.2 | 0.9 | B | A |
| Ex. 5 | C5000 | 9.5:0.5 | 1.75 | 0% | 1.2 | 0.7 | B | A |
| | C5000 | | 1.75 | 100% | 0.4 | 0.2 | C | C |
| Ex. 6 | C5000 Zinc myristate | 7:3 | 3 | 100% | 2.1 | 6.8 | A | A |
| Ex. 7 | C3000 | 9:1 | 3 | 100% | 2.1 | 1.9 | A | A |
| Comp. Ex. 1 | C5000 | 10:0 | 3 | 0% | 2.5 | 0.0 | D | A |
| Comp. Ex. 2 | C5000 | 9.5:0.5 | 2 | 0% | 1.7 | 0.1 | D | A |
| Comp. Ex. 3 | C5000 | 5:5 | 3.5 | 0% | 2.1 | 33.0 | A | D |
| Comp. Ex. 4 | C5000 | 6:4 | 1.75 | 100% | 0.2 | 4.2 | B | D |

<Degree of staining of charging roller>

A: No staining was observed

B: Only slight staining was observed, preferable

C: Staining was observed, but practically applicable

D: Severe staining was observed

<Filming on image bearing member>

A: No staining was observed

B: Only slight staining was observed, preferable.

C: Staining was observed, but practically applicable

D: Severe staining was observed

From comparison of Examples with Comparative Examples shown in the above table, when the protecting agent is supplied to the image bearing member surface so that the amount of zinc (Zn) present on the image bearing member surface satisfies, on the basis of the amount of zinc (Zn) present on the image bearing member surface, the relation $0.4 \leqq Zn \leqq 2.5$ (Atomic %) and the amount of boron (B) present on the surface of the image bearing member satisfies, on the basis of the amount of boron (B) present on the image bearing member surface, the relation $0.2 \leqq B \leqq 30.2$ (Atomic %), it is found that filming on the image bearing member and staining of the charging unit could be prevented. In contrast, as is clear from some Comparative Examples, when the amount of zinc (Zn) present on the image bearing member surface satisfies the relation $0.4 \leqq Zn \leqq 2.5$ (Atomic %) (filming on the image bearing member is prevented as a result of the suppression of the deposition of the protecting agent on the image bearing member surface) but the amount of boron (B) present on the image bearing member surface satisfies the relation $0.2 > B$ (Atomic %), the charging unit was stained likely because the toner particles and/or the protecting agent run through the cleaning member was spread and deposited on the charging unit.

From comparison Examples with each other, it is found that filming on the image bearing member can be effectively prevented when the amount of zinc (Zn) present on the image bearing member surface satisfies the relation $1.0 \leqq Zn \leqq 2.3$ (Atomic %). Also, it is found that staining of the charging unit can be effectively prevented when the amount of boron (B) present on the image bearing member surface satisfies the relation $1.2 \leqq B \leqq 30.2$ (Atomic %).

Although preferred embodiments of the present invention are described above, the present invention is not limited to these specific embodiments. Unless specifically specified in the above description, the present invention can be variously altered or modified without departing from the scope defined by the appended claims.

In one modification embodiment, the image bearing member may be an intermediate transfer member like the transfer belt 11 in the above embodiment, although the image bearing member is a photoconductor in the embodiment described in Examples. In this case, the image bearing member-protecting agent is applied to the intermediate transfer member by the protecting agent-supplying device of the present invention, and this transfer member corresponds to the recording paper in the above embodiment. The process cartridge of the present invention contains the intermediate transfer member. A cleaning device for the intermediate transfer member may be, for example, the cleaning device 13 described in the above embodiment. A charging unit for the intermediate transfer member may be, for example, the primary transfer rollers 12Y, 12M, 12C and 12BK or the secondary transfer roller 5.

The process cartridge of the present invention contains at least the image bearing member and the protecting agent-supplying device in the form of a single member, and may be detachably mounted on the main body of the image forming apparatus. Other constituent parts of the process cartridge are appropriately selected in consideration of service life, cost and mountability onto the process cartridge of the image bearing member and the other constituent parts.

The present invention can be applied to not only a so-called tandem image forming apparatus but also a so-called 1 drum-image forming apparatus in which toner images of colors are sequentially formed on one photoconductor drum and superposed sequentially on top of the other to obtain a full color image. In addition, the present invention can be applied to not only color image forming apparatuses but also monochromatic image forming apparatuses. In either image forming apparatus, the toner images of colors may be directly transferred onto, for example, a recording paper sheet with no use of the intermediate transfer member. In this configuration, the transfer belt 11 illustrated in, for example, FIG. 2 corresponds to the recording paper sheet.

The effects obtained by the above-described embodiments of the present invention are merely most preferable effects obtained in the present invention. The effects of the present invention should not be construed as being limited to those described in the embodiments of the present invention.

What is claimed is:

1. A protecting agent-supplying device which supplies, to an image bearing member, an image bearing member-protecting agent for protecting the image bearing member, wherein the image bearing member-protecting agent contains at least a fatty acid zinc salt and boron nitride, and wherein the protecting agent-supplying device supplies the image bearing member-protecting agent to the image bearing member so that the amount of zinc (Zn) present on a surface of the image bearing member satisfies the relation $0.4 \leqq Zn \leqq 2.5$ (Atomic %) and the amount of boron (B) present on the surface of the image bearing member satisfies the relation $0.2 \leqq B \leqq 30.2$ (Atomic %).

2. The protecting agent-supplying device according to claim 1, wherein the fatty acid zinc salt is zinc stearate.

3. The protecting agent-supplying device according to claim 1, wherein the protecting agent-supplying device comprises a supplying member which scrapes off the image bearing member-protecting agent and supplies the image bearing member-protecting agent to the image bearing member.

4. The protecting agent-supplying device according to claim 1, wherein the protecting agent-supplying device comprises a layer-forming member which forms a layer, on the image bearing member, of the image bearing member-protecting agent supplied to the image bearing member.

5. An image forming apparatus comprising:

the protecting agent-supplying device according to claim 1; and the image bearing member, wherein the protecting agent-supplying device supplies, to the image bearing member, the image bearing member-protecting agent for protecting the image bearing member.

6. The image forming apparatus according to claim 5, further comprising a cleaning device for removing from the image bearing member toner particles remaining on the image bearing member, wherein the cleaning device is provided so as to be in contact with the image bearing member, and wherein the cleaning device is located, in a direction in which the image bearing member is moved, downstream of a position where a toner image on the image bearing member is transferred onto a recording medium but upstream of a position where the image bearing member-protecting agent is supplied by the protecting agent-supplying device.

7. The protecting agent-supplying device according to claim 1, wherein the ratio of the fatty acid zinc and the boron nitride contained in the image bearing member-protecting agent is between approximately 6:4 to 9.5:0.5.

8. The protecting agent-supplying device according to claim 1, wherein the image bearing member-protecting agent consists of fatty acid zinc salt and boron nitride.

9. The protecting agent-supplying device according to claim 1, wherein the amount of zinc (Zn) present on the image bearing member surface satisfies the relation 1.0≦Zn≦2.3 (Atomic %).

10. The protecting agent-supplying device according to claim 1, wherein the amount of boron (B) present on the image bearing member surface satisfies the relation 1.2≦B≦30.2 (Atomic %).

11. A process cartridge comprising:

the protecting agent-supplying device according to claim 1, and the image bearing member to which the image bearing member-protecting agent is supplied by the protecting agent-supplying device.

12. An image forming method comprising:

performing image formation image formation with one of a process cartridge having a protection agent-supplying device and an image forming apparatus having the protection agent-supplying device, wherein the protecting agent-supplying device supplies, to an image bearing member, an image bearing member-protecting agent for protecting the image bearing member, the image bearing member-protecting agent containing at least a fatty acid zinc salt and boron nitride, and the protecting agent-supplying device supplying the image bearing member-protecting agent to the image bearing member so that the amount of zinc (Zn) present on a surface of the image bearing member satisfies the relation 0.4≦Zn≦2.5 (Atomic %) and the amount of boron (B) present on the surface of the image bearing member satisfies the relation 0.2≦B≦30.2 (Atomic %).

13. The image according to claim 12, wherein the process cartridge includes the protecting agent-supplying device and the image bearing member to which the image bearing member-protecting agent is supplied by the protecting agent-supplying device.

14. The image according to claim 12, wherein the image forming apparatus includes the protecting agent-supplying device and the image bearing member to which the image bearing member-protecting agent is supplied by the protecting agent-supplying device.

15. The image forming method according to claim 12, wherein the ratio of the fatty acid zinc and the boron nitride contained in the image bearing member-protecting agent is between approximately 6:4 to 9.5:0.5.

16. The image forming method according to claim 12, wherein the image bearing member-protecting agent consists of fatty acid zinc salt and boron nitride.

17. The image forming method according to claim 12, wherein the amount of zinc (Zn) present on the image bearing member surface satisfies the relation 1.0≦Zn≦2.3 (Atomic %).

18. The image forming method according to claim 12, wherein the amount of boron (B) present on the image bearing member surface satisfies the relation 1.2≦B≦30.2 (Atomic %).

* * * * *